US009168983B2

(12) United States Patent
Lee

(10) Patent No.: US 9,168,983 B2
(45) Date of Patent: Oct. 27, 2015

(54) RV BARGE

(76) Inventor: David C. Lee, Sellersburg, IN (US)

( * ) Notice: Subject to any disclaimer, the term of this patent is extended or adjusted under 35 U.S.C. 154(b) by 218 days.

(21) Appl. No.: 13/507,375

(22) Filed: Jun. 22, 2012

(65) Prior Publication Data

US 2013/0344755 A1 Dec. 26, 2013

(51) Int. Cl.
*B63H 21/175* (2006.01)
*B63B 27/14* (2006.01)
*B63B 35/54* (2006.01)

(52) U.S. Cl.
CPC ..... *B63B 27/143* (2013.01); *B63B 35/54* (2013.01); *B63H 21/175* (2013.01)

(58) Field of Classification Search
CPC ..... B63H 21/175; B60F 3/0092
USPC ..... 440/11, 12
See application file for complete search history.

(56) References Cited

U.S. PATENT DOCUMENTS

| | | | | | |
|---|---|---|---|---|---|
| 1,568,307 | A | * | 1/1926 | Acocella | 440/11 |
| 2,898,877 | A | | 8/1959 | King | |
| 3,265,025 | A | | 8/1966 | Haigh et al. | |
| 3,335,437 | A | | 8/1967 | Judkins | |
| 3,414,916 | A | | 12/1968 | Martin et al. | |
| 3,570,439 | A | | 3/1971 | Snelling | |
| 3,731,644 | A | * | 5/1973 | Bradt | 114/61.1 |
| 3,745,954 | A | | 7/1973 | Louet | |
| 3,807,338 | A | | 4/1974 | Shader | |
| 3,870,011 | A | | 3/1975 | Cooper | |
| 3,964,418 | A | | 6/1976 | Karnik et al. | |
| 4,026,228 | A | | 5/1977 | Reed et al. | |
| 4,109,604 | A | | 8/1978 | Reed | |
| 4,615,289 | A | * | 10/1986 | Bloxham | 114/45 |
| 5,555,837 | A | * | 9/1996 | Marshall et al. | 114/153 |
| 5,607,330 | A | * | 3/1997 | Hanz | 440/11 |
| 6,029,598 | A | | 2/2000 | Stoll | |
| 6,293,838 | B1 | * | 9/2001 | Ferguson | 440/84 |
| 6,439,145 | B1 | | 8/2002 | Mensch | |
| 7,487,734 | B2 | | 2/2009 | Davis | |
| 2009/0084303 | A1 | | 4/2009 | Kazmierowicz | |

* cited by examiner

*Primary Examiner* — Lars A Olson
*Assistant Examiner* — Andrew Polay
(74) *Attorney, Agent, or Firm* — Carrithers Law Office, PLLC

(57) ABSTRACT

A vessel for carrying an RV (recreational vehicle) through the water, thereby effectively converting the RV to a houseboat. The barge-like vessel includes ramps for loading and unloading an RV at a boat ramp. The barge is powered by the drive wheels of the RV, wherein the drive wheels are each resting on two rotatable cylinders similar to a dynamometer cradle. The wheels spin the cylinders which in turn rotate the propellers so that the speed is controlled by the speed at which the drive wheels turn. Direction is controlled by a knob on a fly-by-wire type device which in turn controls the rudder. An alternative directional control includes two turntables onto which the front wheels rest. One of the turntables is mechanically connected to the rudder so that the steering wheel controls the rudder. Ballast tanks are provided at each side of the front and back of the barge to keep the barge level.

15 Claims, 5 Drawing Sheets

RV BARGE

TECHNICAL FIELD

The present invention relates to the field of vessels designed to carry a recreational vehicle on a body of water.

BACKGROUND OF THE INVENTION

Camping vacationers require vehicles with a greater degree of comfort, flexibility and luxury. RV's (recreational vehicles) provide varying degrees of comfort and luxury and are popular with vacationers all over the world. House trailers, camping trailers, camper buses, collapsible tents, trailer tents and motor homes exemplify attempts to satisfy the need for comfortable traveling vehicles. The configuration of houseboats continues to grow in size and complexity as the demand for increased room, comfort and luxuries grows. The expense of having and maintaining both a luxurious houseboat and RV is too great for the average vacationer.

A reasonable and economical solution for a vacationer requiring both a houseboat and a recreational vehicle is a barge type vehicle which will carry a recreational vehicle. The barge is either propelled by a separate motor or receives power from the drive wheels of the RV. The driver controls the barge from the driver's seat in the RV. The RV provides all the comforts of home while being carried over the water on the barge just as if the RV were on land, so that all of the requirements of the vacationers are provided by the RV and need not be provided separately on the barge. Loading ramps and the stabilizing equipment needed during loading and unloading of the RV are provided on the barge.

DESCRIPTION OF THE RELATED ART

U.S. Pat. No. 3,873,011 by Cooper for COMBINED MOTOR HOME AND YACHT issued on Mar. 11, 1975 teaches a yacht hull which can receive and carry a recreational vehicle and which is self powered by a marine type engine and whereby various controls are made available to the driver's quarters within the RV or in a remote location on the yacht. Cooper requires that the RV must be hoisted into position on the yacht rather than rolled or driven onto the boat as provided by the present invention. Further, power to propel the boat is preferably provided by the RV in the present invention.

U.S. Pat. No. 3,570,439 by Snelling for NAVIGATION CONTROL MECHANISM issued on Mar. 16, 1971 teaches a navigable vessel which can receive and carry a recreational vehicle. The vessel is self powered and contains a control console which includes a mechanical remote unit which can be mounted within the RV so that the vessel may be controlled from within the RV. Snelling differs from the present invention in that no provision is made to stabilize the vessel during the loading of the RV and the present invention provides that the vessel is propelled by the RV engine.

U.S. Pat. No. 3,731,644 by Bradt for CATAMARAN VESSEL AND SYSTEM FOR LOADING AND UTILIZING A CAMPER OR TRAILER THEREON issued on May 8, 1973 teaches a vessel adapted to receive and carry a pickup camper body or a house trailer. Bradt's vessel includes a winching system for loading the camper or trailer onto the vessel. Bradt is self-powered with the controls on a driver's podium whereas the present invention provides for vessel control from within a recreational vehicle and the vessel being powered by the RV engine. Further, directional controls are within the RV as well.

SUMMARY OF THE INVENTION

In accordance with the present invention, there is provided A recreational vehicle barge including an generally rectangular hull including front, rear, left and right walls, a top deck and a bottom wall. The hull includes four ballast tanks, one at each corner thereof with each of the ballast tanks being in fluid communication with a barge leveling pump unit. The barge leveling pump being is also in fluid communication with outside lake water. The pump unit is powered from a recreational vehicle on the hull through electrical cables connected to a junction box at the rear of the recreational vehicle. The upper peripheral marginal edges of the deck include a personnel safety fence extending upward therefrom. The fence contains recreational vehicle loading gates at a front portion thereof and personnel egress gates in right and left portions thereof. The deck includes two cradles containing parallel cylinders capable of supporting drive wheels of the recreational vehicle. The cylinders are capable being rotated by the rotation of the drive wheels and of being locked during loading and unloading of the recreational vehicle. At least one of the cylinders is connected to means for cooperatively engaging such as a belt, chain or sprocket assembly for driving at least one gearbox, said at least one gearbox and drives at least one gearbox which drives at least one propeller at the lower rear of the hull for the purpose of propelling the hull. The drive wheel cause the cylinders to rotate when the drive wheel are driven by an engine and transmission within the recreational vehicle. The deck has slots positioned near the resting place of the four wheels of the recreational vehicle to be used to secure tie down chains used for stabilizing the recreational vehicle. The hull includes at least one steering rudder located downstream of the at least one propeller. The rudder is controlled by rudder control means. The recreational vehicle barge is controlled from a driver's seat with a 'fly-by-wire' control unit removably mounted on a steering wheel within the recreational vehicle. The fly-by-wire unit is capable of controlling a speed at which the wheels turn by controlling a throttle of said engine powering said recreational vehicle and, therefore, a speed at which the propeller turns. The hull includes drop down jacks on each two front corners for stabilizing the hull on a boat ramp and at least one winch and cable unit for rigidly securing the hull to an anchoring means on the ramp when loading or unloading said recreational vehicle. The hull includes loading ramps capable of being removably attached to a front edge of the hull between the loading gates and located to enable loading and unloading of the recreational vehicle from the ramp onto the hull.

The RV barge is a vessel designed to carry any RV (recreational vehicle) motor home over the water, thereby converting this motor home into a houseboat. In the present application, the terms RV and recreational vehicle refer to a self powered, two axle motor home. The barge is piloted from the driver's seat of the motor home. The vessel is capable of having a recreational vehicle loaded or unloaded from any boat launch ramp, thus allowing use on lakes, rivers or ocean waters. The barge is sized to accommodate any recreational vehicle.

The recreational vehicle provides power for the barge. Means of propulsion by propeller or water pump is obtained by cradling the drive wheel of the recreational vehicle on two cylindrical rollers so that as the drive wheel turn, the cylinders are caused to turn as well and at least one of the cylinders drives a shaft that is mechanically connected to the barge's propellers. This mechanical connection allows the speed in both forward and reverse to be directly controlled by the recreational vehicle driver. The driver puts the recreational vehicle into reverse when the barge is required to move backwards. Steering is obtained through an electrical or electronic fly-by-wire device. The required electrical power for steering, running lights, and so on, is obtained from a power cord connector on the rear of the recreational vehicle and the fly-by-wire device has a separate control cable.

Another embodiment of the barge has a steering mechanism wherein at least one of two turntables, one under each of the front wheels, is mechanically connected directly two each of two rudders. When the steering wheel is turned, the front wheels rotate, thus causing the turntables to rotate. This motion causes the rudders to rotate to control the direction of the barge.

Tie-down slots are provided in the deck to secure the vehicle to the vessel. Also provided is storage space for the required Personal Floatation Devices. Ballast tanks are included on both sides of the vessel at the front and rear and are filled or emptied by at least one manually controlled pump and plurality of valves to level the barge as needed.

Loading the motor home onto the vessel is simple and safe. To do this, the bow is secured against the concrete boat ramp by two retractable jack stands attached to the front corners of the barge. Ropes or cables are used to secure the vessel to a post or tie down on the ramp. Small loading ramps are secured to the front upper edge of the barge with the other ends of the ramps resting on the concrete boat ramp. The recreational vehicle is then backed onto the barge with the drive wheel resting in the cylinder cradles and the front wheels centered on the steering turntables if this type of steering is used.

Since not all recreational vehicles, such as travel trailers, fifth wheel trailers and front wheel drive vehicles, have rear drive wheels, another embodiment of the barge is provided with an on-board motor such as an out-board motor drive. This embodiment includes a transom, the motor and fuel tank, and a different fly-by-wire device which controls steering and throttle.

It is an object of this invention to provide a barge configured to receive, carry and be powered by a recreational vehicle.

It is an object of this invention to provide a recreational vehicle barge which provides the desired recreational appointments available in a recreational vehicle combined with the capability of traveling over the water, thereby removing the expense of owning both a recreational vehicle and a houseboat.

It is an object of this invention to provide a recreational vehicle barge which is totally controlled from the RV driver's seat using the same steering and directional controls as those used when driving the RV.

It is an object of this invention to provide an alternative embodiment of a recreational vehicle barge which is totally controlled from the RV driver's seat using a 'fly-by-wire' remotely control led steering and directional control system.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
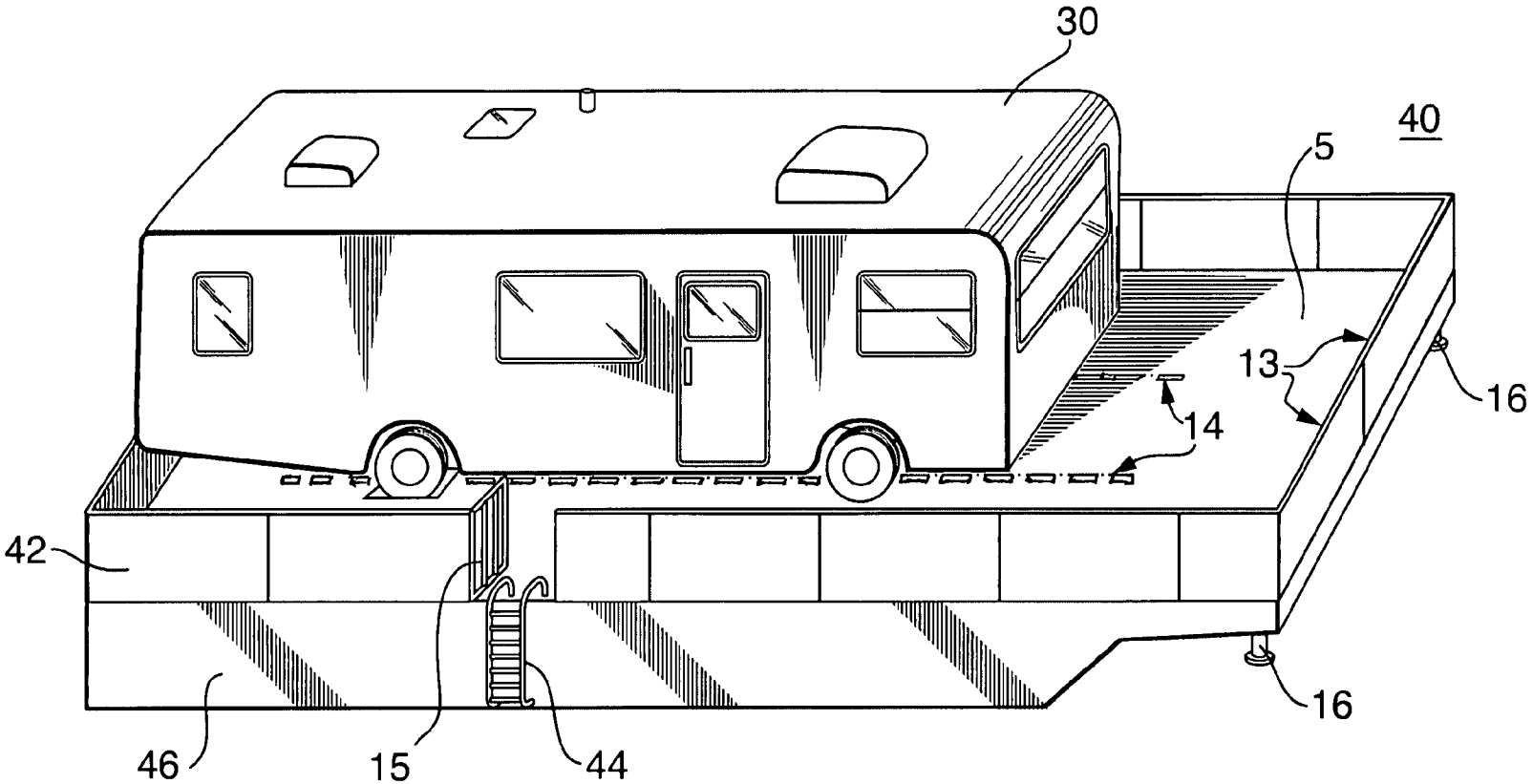
FIG. 1 is a perspective drawing of a recreational vehicle barge carrying a recreational vehicle.
Figure 2:
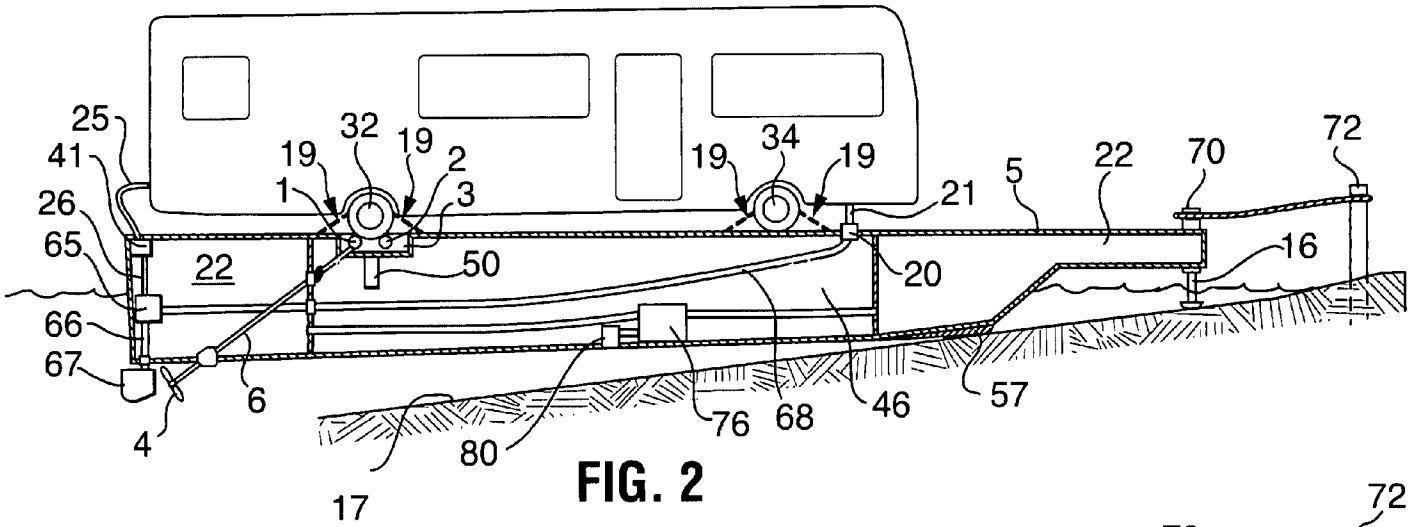
FIG. 2 is a side view of the barge carrying a recreational vehicle.

A recreational vehicle barge 40 is shown in FIG. 1 whereon a recreational vehicle 30 is loaded. Barge 40 includes a hull 46 with a top surface defining a deck 5 with personal safety fence 42 extending upward from the peripheral marginal edge of the deck 5. Safety fence 42 includes front gates 13 which are preferably opened only when loading or unloading the recreational vehicle 30. Fence 42 also includes two gates 15, one on each side of barge 40, for a user to enter or leave the deck 5 of barge 40. A ladder 44 may be removably attached to deck 5 within the opening provided by gate 15 to allow a user to ascend from or descend to the water. A layer of reinforcing steel plate 57 is added to hull 46 at the position where the hull is more likely to contact the concrete boat ramp 17 during loading or unloading, as shown in FIG. 2. Screw down jacks 16 are provided at each front corner of barge 16 to support barge 40 during loading and unloading. When used properly, jacks 16 will prevent hull 46 from contacting concrete boat ramp 17 during loading and unloading.

Figure 3:
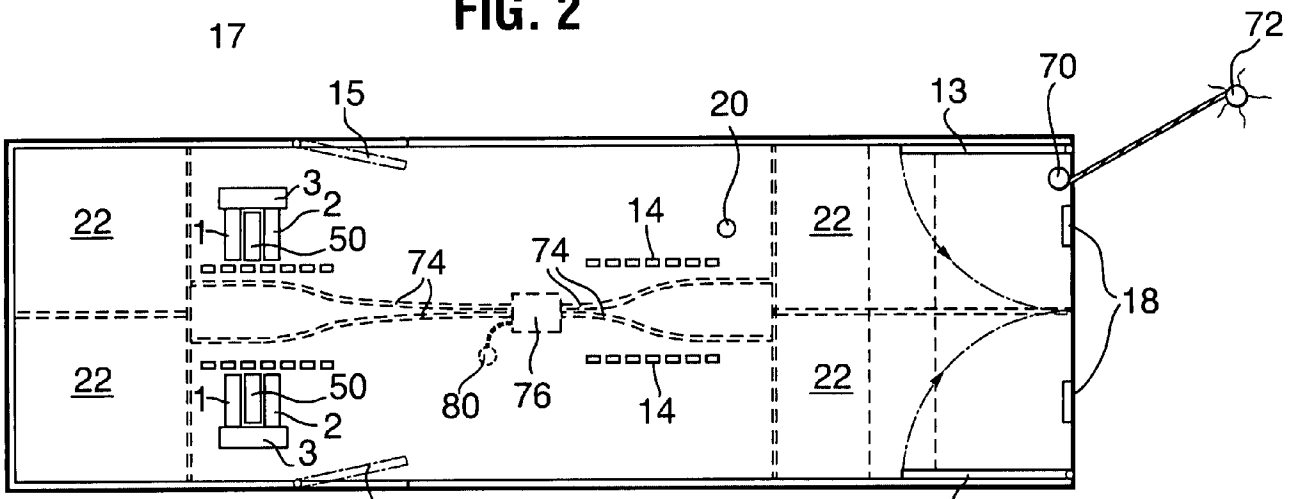
FIG. 3 is a top view of the RV barge.
Figure 4:
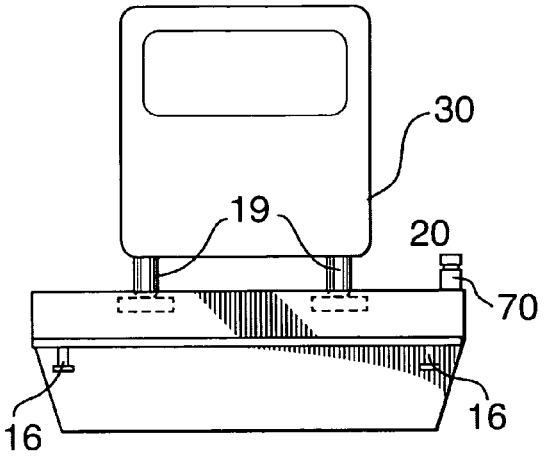
FIG. 4 is an front end view of the barge carrying a recreational vehicle.
Figure 5:
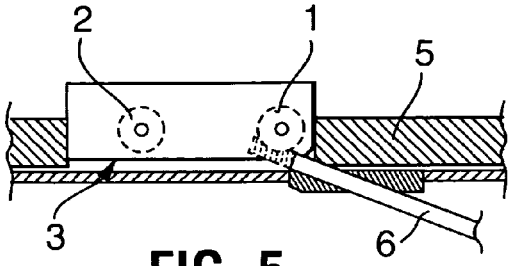
FIG. 5 is a side view of the power roller cylinders and gear box.
Figure 12:
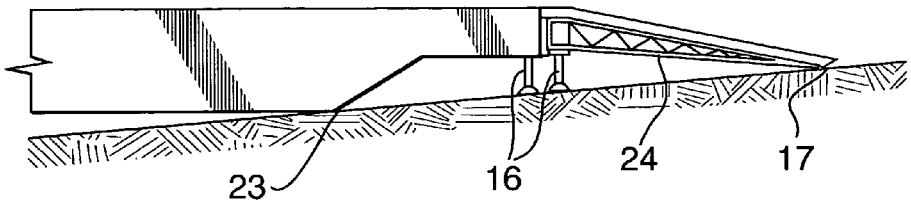
FIG. 12 is a partial side view of a barge at a boat ramp ready to receive a recreational vehicle.
Figure 13:
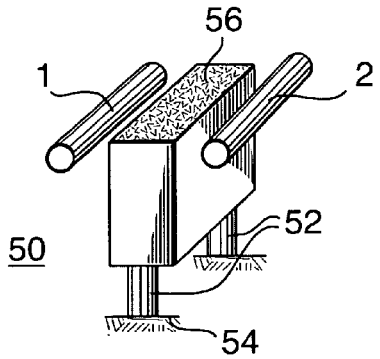
FIG. 13 is a perspective view of the rear wheel traction plate support 50.

As shown in FIGS. 2 and 3, ballast tanks 22 are included at the left and right sides of the front and rear corners of hull 46. Ballast tanks 22 are emptied or filled with water to maintain a level deck 5. The pump and valve unit 76 is in fluid connection with each of the four ballast tanks 22 and water under hull 46 through bung 80 by way of water pipes 74 and is manually controlled to maintain proper level control of barge 40. It is anticipated that an automatic leveling system could be installed to maintain the vessel in a level attitude. Power for pump and valve unit 76 is provided by power connection cable 25 at the rear of the recreational vehicle 30. Loading ramp receiver slots 18 shown in FIG. 3 are provided for engaging and holding one end of the portable loading ramps 24 shown in FIG. 12. An alternative embodiment of barge 40 includes at least one winch and cable 70 for positively and securely tethering barge 40 to a stable tie down 72 on the ground or marina when loading or unloading the recreational vehicle.

Barge 40 includes storage areas for personal floatation devices, loading ramps 24, a personnel ladder 44, and so on, as desired by a user.

Deck 5 includes means for positioning defining a plurality of depressions or tie down slots 14 defining a pair of spaced apart parallel longitudinal members positioned in close proximity to the expected resting point for the four wheels 32 and 34 of recreational vehicle 30. Chains and/or straps 19 are attached to deck 5 within selected ones of slots 14 and then to the suspension or frame of recreational vehicle 30 or to wheels 32 and 34. As shown in FIGS. 5-8, deck 5 has a cradle 80 having mounted therein two gear boxes 3 with cylinders 1 and 2 which are positioned to received each of drive wheel 32. When loading recreational vehicle 30, the two drive wheel (as shown rear wheels) 32 come to rest on and are then supported by cylindrical rollers 1 and 2. Rollers 2 are idler rollers but rollers 1 are connected through gears in each gearbox 3 to propeller drive shafts 6, in order to drive each propeller 4, one on the left and one on the right of barge 40. Rollers 2 are locked during loading and unloading of the recreational vehicle 30 to give traction to the drive wheel 32. An alternate embodiment of barge 40 includes rear wheel traction plate supports 50 for improved traction during loading and unloading. Rear wheel traction plate supports 50 are raised so that the traction plates 56 are level with or at least near the upper most surface of rollers 1 and 2 when the recreational vehicle 30 is being loaded or unloaded. This provides the drive wheel 32 with extra traction to roll onto or off of rollers 1 and 2. Rear wheel traction plate supports 50 are raised or lowered with power units 52 which are permanently attached to the top surface 54 of the bottom of hull 46 and which can be hydraulically or mechanical driven. When the recreational vehicle 30 is stopped with wheels 32 centered over the rollers 1 and 2, rear wheel traction plate supports 50 are lowered to caused the wheels 32 to rest on the rollers 1 and 2 so that the wheels can now drive the rollers 1 and 2. Idler rollers 2 are unlocked at this point, also.

Figure 6:
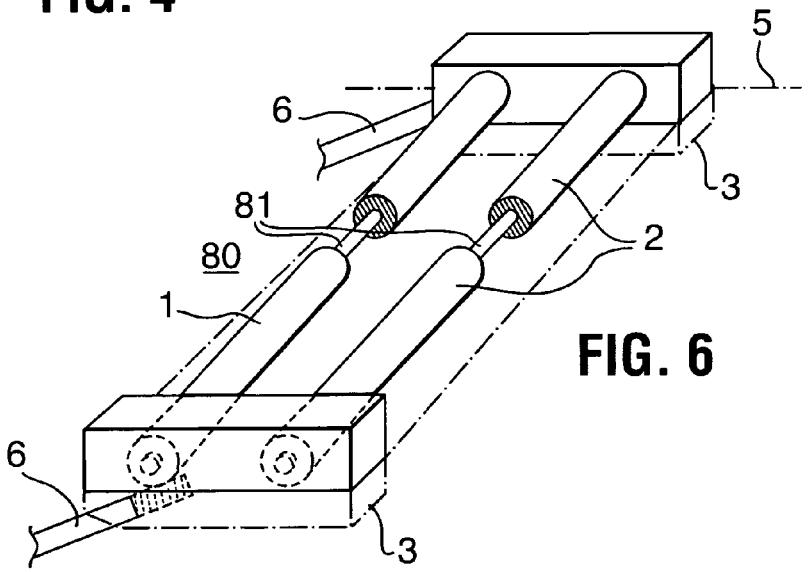
FIG. 6 is a perspective view of the power roller cylinders and gear boxes.
Figure 7:
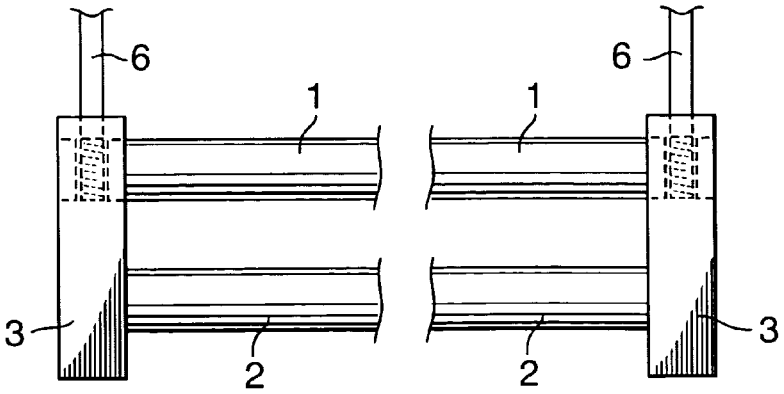
FIG. 7 is a top view of the power roller cylinders and gear boxes.
Figure 8:
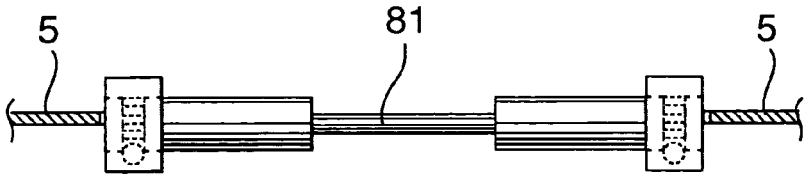
FIG. 8 is front view of the cylinders and gear boxes mounted within the deck surface.

The two rollers 1 are connected by a solid shaft 81 as shown in FIGS. 6 and 8, so that both rollers 1 always turn in synch with one another. This is necessary since the differential which drives the two wheels 32 on the recreational vehicle would allow an undesirable mismatch of speeds between roller 1 on the left side and roller 1 on the right side, resulting in unstable directional control of the barge 40. It is anticipated that one continuous cylinder which is long enough to contact and be driven by both drive wheel 32 may be used to replace the two rollers 1 and the shaft 81 connecting the two. Another embodiment of barge 40 uses only one gearbox 3 to drive either one propeller 4 or two propellers 4. It is also anticipated that the barge propulsion comprise water jets driven by either the drive wheel, engine and transmission arrangement comprising the drive system, and/or an electric pump powered by the electric system of the recreational vehicle directly engaging the transmission, and/or batteries chargeable by the drive system, and/or a generator powered by the drive system.

Rollers 1 preferably drive shafts 6 through a worm gear arrangement. It is anticipated, however that bevel gears or any other appropriate gear arrangement will perform the same function. Rollers 1 and 2 are preferably at least 6 inches in diameter to provide ample frictional surface contact between the tires and the cylinders and to provide proper support and traction for the tires.

A floor or dash mounted lever in the recreational vehicle is mechanically connected to the accelerator linkage to maintain a consistent wheel speed and thus barge speed.

Two rudders 67 are positioned downstream of propellers 4. Rudders 67 are connected to steering gearboxes 65 by intermediate shafts 66. Gear boxes 65 are electrically driven by an internal motor controlled from the fly-by-wire steering controller 7 which is mounted on the steering wheel 10 within recreational vehicle 30 shown in FIG. 9. Power cable 25 connects recreational vehicle 30 to barge 40 at connector box 41. Cable 26 further connects box 41 to steering gear boxes 65 to provide electrical power. The control signal for the rudders 67 comes from the fly-by-wire steering controller 7 which is connected to gear box 65 through cable 68, connector 20 and cable 21.

Figure 9:
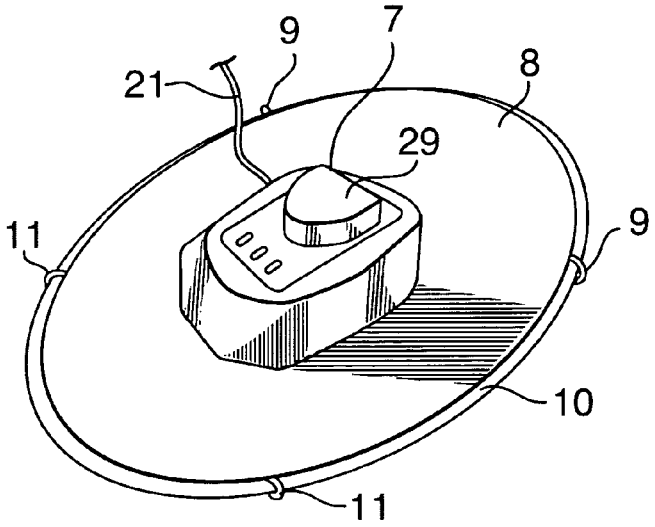
FIG. 9 is a perspective drawing of the fly-by-wire device removably mounted on a steering wheel.
Figure 10:
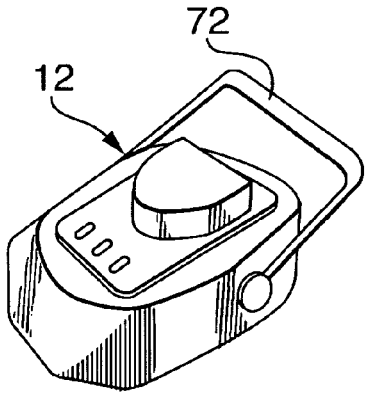
FIG. 10 is a perspective drawing of an alternate fly-by-wire device.
Figure 11:
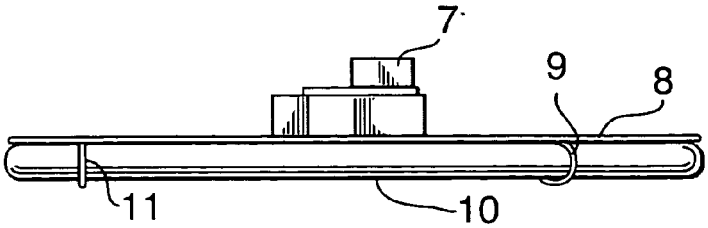
FIG. 11 is a side view of the fly-by-wire device in FIG. 9.

FIGS. 9-11 show fly-by-wire control unit 7 and a mounting arrangement wherein control unit 7 is fixed to a disk 8 which has a diameter just less than the diameter of the recreational vehicle steering wheel 10. Fixed hooks 9 on disk 8 embrace one half of the steering wheel 10. Movable hooks 11 which are held in place by springs or a bungee cord, embrace the other half of steering wheel 10 and therefore allow a user to attach or remove disk 8 from steering wheel 10 as desired. Controller 7 contains a rotatable knob 29 which may rotated to the left or right causing motorized gearbox 65 to turn rudder 67 to the left or right.

Another embodiment of barge 40 contains either an outboard motor or a separate motor for driving the propeller or propellers 4 and is, therefore, self powered. A different fly-by-wire throttle controller unit 12 shown in FIG. 10 includes a throttle control lever 72 which controls the speed and direction of barge 40. The throttle control lever module 72 sends a digitally encoded position signal to a throttle control module which in turn moves the throttle linkage on the motor driving the propeller or propellers 4 to the selected digitally encoded position.

Figure 14:
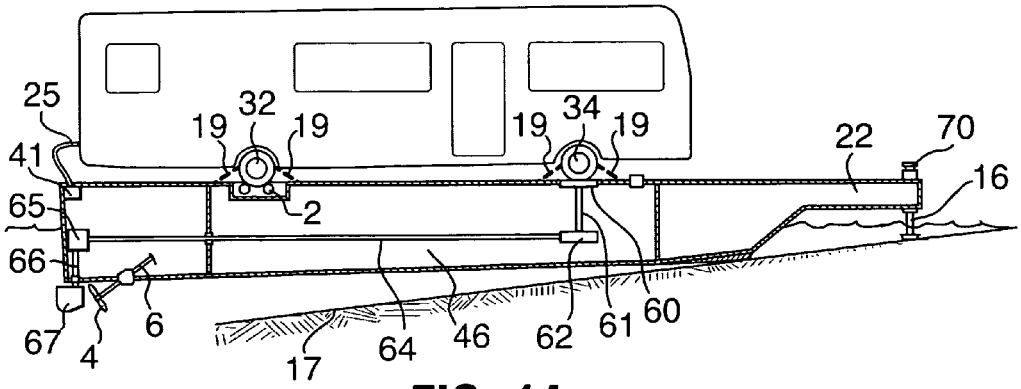
FIG. 14 is a side view of the recreational vehicle barge showing the turntable controlled steering system.

A further embodiment of the barge shown in FIG. 14, has rudders mechanically controlled directly by turning the steering wheel. When the recreational vehicle 30 is loaded onto the barge 40, the front wheels 34 each come to rest on turntables 60. When the steering wheel 10 turns front wheels 34, this causes turntables 60 and turntable shaft 61 to rotate. Shaft 61 is mechanically connected to intermediate shaft 64 through gearbox 62. As shaft 64 rotates, gears in gearbox 65 cause shaft 66 to rotate. Rudder 67 is fixed onto shaft 66 and thus rotates as well. Therefore, steering wheel 10 in the recreational vehicle 30 is mechanically connected directly to rudders 67.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A recreational vehicle barge comprising;

a generally rectangular barge including a front wall, a rear wall, a left wall, a right wall, a deck and a bottom hull, said barge including at least one ballast tank at each corner of said barge, each one of said ballast tanks being in fluid communication with a barge leveling pump unit, said barge leveling pump being in fluid communication with outside water, said pump unit receiving power from a recreational vehicle resting on said barge deck in electrical communication therewith through electrical cables connected to a junction box of said recreational vehicle;

said deck including a pair of cradles, each one containing at least one pair of spaced apart parallel rotatable cylinders capable of supporting a driving wheel of said recreational vehicle, said at least one pair of spaced apart parallel rotatable cylinders in rotational cooperation engagement with said driving wheel, said at least one of said pair of spaced apart parallel rotatable cylinders connecting to means for cooperatively engaging and driving at least one gearbox, said at least one gearbox powering a means for propulsion selected from the group consisting of propeller, a water pump, and combinations thereof disposed at a lower rear of said barge, said driving wheel rotating said at least one pair of spaced apart parallel rotatable cylinders upon engaging an engine and transmission within said recreational vehicle in cooperative engagement with said driving wheel, said at least one pair of spaced apart parallel rotatable cylinders providing a means for positioning said recreational vehicle, said deck including a tie down for engaging at least one attachment point of said recreational vehicle securing same to said deck;

said barge including at least one steering rudder and rudder assembly located downstream of said means of propulsion, said rudder being controlled by a rudder control means including a control unit removably mounted on a steering wheel within the recreational vehicle;

said barge including means of throttle control comprising a control unit removably mounted on a steering wheel of said recreational vehicle, said control unit being capable of controlling a speed at which said drive wheels turn by controlling a throttle of said engine powering said recreational vehicle;

including a traction plate capable of being raised and held to a position between said parallel cylinders to a top surface of said parallel cylinders for the purpose of improving traction available to said drive wheels of said recreational vehicle as said drive wheels move to and from a position between said parallel cylinders, said traction plates being capable of retracting to a position under said parallel cylinders and below a bottom surface of said drive wheels after said recreational vehicle is loaded onto said barge; and said barge including a drop down jack assembly on each of a front corner of said barge for stabilizing said hull on a boat ramp during on and off loading of said recreational vehicle and at least one winch and cable unit for securing said barge to a stationary object on shore when loading or unloading said recreational vehicle.

2. The recreational vehicle barge defined in claim 1 wherein said rudder control means includes a knob on said control unit which send control voltage to an electric motor, said motor being connected through a gear box to said at least one rudder.

3. The recreational vehicle barge defined in claim 1 wherein said rudder control means comprises a first turn table on which a first front wheel of said recreational vehicle is resting, a second turn table on which a second front wheel of said recreational vehicle is resting, said turn tables being in rotational communication with at least one shaft driving a gearbox which controls the direction in which said at least one rudder is pointing, thus allowing a user to control said at least one rudder by turning the steering wheel of said recreational vehicle.

4. The recreational vehicle barge defined in claim 1, including an upper peripheral marginal edge of said deck including a personnel safety fence extending upward therefrom, said fence containing recreational vehicle loading gates at a front portion thereof and personnel egress gates in right and left portions thereof.

5. The recreational vehicle barge defined in claim 1, wherein said cylinders are lockable during loading and unloading of said recreational vehicle.

6. The recreational vehicle barge defined in claim 1, including at least one slot formed within a top surface of said deck for cooperatively engaging and holding said recreational vehicle in position.

7. The recreational vehicle barge defined in claim 1 wherein said means of propulsion comprises at least one propeller.

8. The recreational vehicle barge defined in claim 1 wherein said means of propulsion comprises a water jet propulsion device including a pump.

9. The recreational vehicle barge of claim 1, including a loading ramp capable of being removably attached to a front edge of said barge extendable between said deck and said boat ramp.

10. The recreational vehicle barge defined in claim 1 wherein said rudder control means includes a knob on said control unit which send control voltage to an electric motor, said motor being connected through a gear box to said at least one rudder.

11. The recreational vehicle barge of claim 1, wherein a second means for positioning comprises a pair of spaced apart parallel longitudinal members.

12. The recreational vehicle barge of claim 11, wherein said second means for positioning comprises a plurality of depressions forming a pair of spaced apart parallel lines.

13. The recreational vehicle barge of claim 1, wherein said tie down for engaging at least one attachment point of said recreational vehicle securing same to said deck comprises at least one tie down slots for cooperatively engaging a strap or chain for holding a frame of said recreational vehicle in a stationary position.

14. A recreational vehicle barge comprising:

a barge;

said barge including at least one steering rudder and rudder assembly located downstream of a means of propulsion, said rudder being controlled by a rudder control means;

said deck including a pair of cradles, each one containing at least one pair of spaced apart parallel rotatable cylinders capable of supporting a driving wheel of said recreational vehicle, said cylinders in rotational cooperation engagement with at least one driving wheel, at least one of said pair of parallel cylinders being connected to means for cooperatively engaging and driving at least one gearbox, said at least one gearbox powering means for propulsion disposed at a lower rear of said barge, said at least one drive wheel rotating said cylinders upon engaging an engine and transmission within said recreational vehicle in cooperative engagement with said at least one drive wheel, said deck including means for positioning said recreational vehicle, said deck including tie down means for engaging at least one attachment point of said recreational vehicle securing same to said deck;

said barge including throttle control unit being capable of controlling a speed at which said at least one drive wheel turn by controlling a throttle of said engine powering said recreational vehicle;

a traction plate capable of being raised and held to a position between said parallel cylinders to a top surface of said parallel cylinders for the purpose of improving traction available to said at least one drive wheel of said recreational vehicle as said at least one drive wheel moves to and from a position between said parallel cylinders, said traction plates being capable of retracting to a position under said parallel cylinders and below a bottom surface of said at least one drive wheel after said recreational vehicle is loaded onto said barge; and said barge including means for securing a front of said barge on a boat ramp during on and off loading of said recreational vehicle.

15. A recreational vehicle barge consisting of:

a generally rectangular barge including a deck and a bottom hull, said barge including a plurality of ballast tanks including one ballast tank at each corner of said hull, each one of said ballast tanks being in fluid communication with a barge leveling pump unit, said barge leveling pump being in fluid communication with outside water, said pump unit receiving power from a recreational vehicle resting on said barge deck in electrical communication therewith through electrical cables connected to a junction box of said recreational vehicle;

said barge including one steering rudder and rudder assembly located downstream of a means of propulsion, said rudder being controlled by a rudder control means including a control unit removably mounted within said recreational vehicle having a controller with a rotatable knob which sends control voltage to an electric motor in cooperative engagement with one stern drive unit having a propeller or water pump for steering and propelling said barge;

said deck including a pair of cradles, each one containing one pair of spaced apart parallel rotatable cylinders capable of supporting a driving wheel of said recreational vehicle, said cylinders in rotational cooperation engagement with at least one driving wheel, at least one of said pair of parallel cylinders being connected to means for cooperatively engaging and driving one gearbox, said one gearbox powering a means for propulsion means for propulsion selected from the group consisting of a propeller, a water pump, and combinations thereof disposed at a lower rear of said barge, said at least one drive wheel rotating said cylinders upon engaging an engine and transmission within said recreational vehicle in cooperative engagement with said at least one drive wheel, said at least one pair of spaced apart parallel rotatable cylinders providing means for positioning said recreational vehicle, said deck including a tie down for engaging at least one attachment point of said recreational vehicle securing same to said deck;

said barge including throttle control unit being capable of controlling a speed at which said at least one drive wheel turn by controlling a throttle of said engine powering said recreational vehicle; and said barge including means for securing a front of said barge on a boat ramp during on and off loading of said recreational vehicle.

* * * * *